US007065988B2

(12) United States Patent
Lonati

(10) Patent No.: US 7,065,988 B2
(45) Date of Patent: Jun. 27, 2006

(54) DEVICE FOR VARYING STITCH TIGHTNESS FOR KNITTING MACHINE FOR HOSIERY OR THE LIKE, PARTICULARLY FOR CIRCULAR KNITTING MACHINES

(75) Inventor: Francesco Lonati, deceased, late of Brescia (IT); by Ettore Lonati, legal representative, Brescia (IT); by Fausto Lonati, legal representative, Brescia (IT); by Tiberio Lonati, legal representative, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/498,308

(22) PCT Filed: Dec. 11, 2002

(86) PCT No.: PCT/EP02/14063

§ 371 (c)(1),
(2), (4) Date: Aug. 29, 2005

(87) PCT Pub. No.: WO03/052187

PCT Pub. Date: Jun. 26, 2003

(65) Prior Publication Data

US 2005/0284188 A1 Dec. 29, 2005

(30) Foreign Application Priority Data

Dec. 14, 2001 (IT) ..... MI2001A2650

(51) Int. Cl.
*D04B 15/36* (2006.01)

(52) U.S. Cl. ..... 66/78

(58) Field of Classification Search ..... 66/75.1, 66/77, 78, 27, 37, 46, 57, 64, 64 H
See application file for complete search history.

(56) References Cited

U.S. PATENT DOCUMENTS

| | | | | |
|---|---|---|---|---|
| 2,069,155 | A * | 1/1937 | Lawson | 66/107 |
| 4,712,390 | A * | 12/1987 | Lonati | 66/54 |
| 5,284,032 | A * | 2/1994 | Shima | 66/77 |
| 6,158,251 | A * | 12/2000 | Sangiacomo | 66/78 |

FOREIGN PATENT DOCUMENTS

| | | |
|---|---|---|
| EP | A-0 185 266 | 6/1986 |
| EP | A-1 054 090 | 11/2000 |
| GB | A-354 135 | 8/1931 |
| GB | A-1 507 615 | 4/1978 |

* cited by examiner

*Primary Examiner*—Danny Worrell
(74) *Attorney, Agent, or Firm*—Modiano & Associati; Albert Josif; Daniel O'Byrne

(57) ABSTRACT

A device for varying stitch tightness for hosiery knitting machines, particularly for circular knitting machines, which comprises a movement adjuster connected to a slider that can slide in the cam box of the machine and supports a knockover cam of the machine. The movement adjuster comprises an actuator, connected to an adjustment cam and actuatable so as to turn the adjustment cam about its own axis through preset angles. The adjustment cam has a single external active profile, two cam followers being arranged on the slider to make contact with the active profile of the adjustment cam in two spaced points and cooperate in determining a bilateral coupling with the adjustment cam.

18 Claims, 3 Drawing Sheets

DEVICE FOR VARYING STITCH TIGHTNESS FOR KNITTING MACHINE FOR HOSIERY OR THE LIKE, PARTICULARLY FOR CIRCULAR KNITTING MACHINES

The present invention relates to a device for varying stitch tightness for knitting machines for hosiery or the like, particularly for circular knitting machines.

BACKGROUND OF THE INVENTION

As is known, circular knitting machines for hosiery or the like generally comprise a needle holder, constituted by the needle cylinder and/or the dial, which faces a cam box that supports a plurality of cams for actuating the needles during the operation of the machine.

More particularly, on the face of the needle holder that faces the cam box there are multiple slots, which are parallel to the axis of the needle cylinder if the needle holder is constituted by the needle cylinder or are arranged radially around the axis of the dial if the needle holder is constituted by the dial of a cylinder-and-dial circular machine. Inside each one of these slots there is a needle, which can slide along the corresponding slot in order to form knitting. The needles can be actuated directly by the cams of the cam box or by interposing needle pushers, each arranged in the same slot of the needle holder that accommodates the corresponding needle. The needles and optionally the needle pushers have heels, which protrude from the needle holder toward the cam box and can engage within paths formed by the cams. The needle holder, during the operation of the machine, is actuated with a direction of motion with respect to the cam box such that the heels of the needles or of the needle pushers engage within said paths, which have portions that are suitably inclined with respect to said direction of motion in order to produce the reciprocating motion of the needles along the corresponding slots of the needle holder. This reciprocating motion causes the needles to pick up the threads provided at one feed or drop of the machine and form loops of knitting.

The cam that moves the needle after the needle has engaged the thread at a feed of the machine is known as knockover cam, since it causes a movement of the needle that forms a new loop of knitting, knocking over the previously formed loop of knitting if said loop, during the engagement of the thread on the part of the needle, has been placed below the open latch of the needle.

The knockover cam has a profile that can be engaged by the heels of the needles or of the needle pushers and is inclined with respect to the direction of motion of the needle holder with respect to the cam box to achieve this very movement of the needle.

Said knockover cam is arranged directly after a feed or drop of the machine, and causes the retraction of the needles into the slots formed on the lateral surface of the needle cylinder or in the dial, after said needles have been extracted to engage the thread at the drop or feed.

In many kinds of hosiery knitting machine, the knockover cam is mounted on a slider that can move on command with respect to the cam box along an adjustment direction that is parallel to the extension of the slots of the needle holder that accommodate the needles or needle pushers that in each instance engage said cam, so as to allow to vary the extent of the movement of the needles during the forming of new loops of knitting and therefore vary the length of the loops of knitting.

The movement of the slider and therefore of the knockover cam with respect to the cam box is achieved very often by means of an actuator, which is generally constituted by an electric motor, for example of the step type, which is connected by means of its output shaft to an adjustment cam that acts, with its profile, on a cam follower that is associated with the slider. In practice, the rotation of the adjustment cam about its own axis through preset angles causes, due to the shape of the profile of the adjustment cam, a movement of the slider and therefore of the knockover cam with respect to the cam box, varying the position of the knockover cam along the adjustment direction, which is perpendicular to the direction of motion of the needle holder with respect to the cam box, thus varying the extent of the movement of the needles produced by said knockover cam along the corresponding slot of the needle holder and therefore varying the tightness of the knitting.

In some devices, the contact between the cam follower associated with the slider that supports the knockover cam and the profile of the adjustment cam is maintained by means of pneumatic pushers or springs. To achieve an extremely precise adjustment of the tightness of the knitting, the cam follower must never disengage from the profile of the adjustment cam. For this reason, there is a tendency to increase the load of the spring or the force of the pneumatic pushers that push the cam follower against the profile of the knockover cam. This method, aimed at eliminating the onset of plays between the profile of the adjustment cam and the cam follower, has the drawback of increasing the contrast torque that opposes the rotation of the adjustment cam and reducing the speed in varying the tightness of the knitting; to obviate this, it is necessary to use more powerful electric motors to drive the adjustment cam.

In order to solve the problem of eliminating plays between the cam follower and the profile of the adjustment cam, it has been proposed to adopt two adjustment cams that are monolithic, rotate about a same axis and engage two cam followers, which are associated with the slider and make contact with the two profiles of the adjustment cams in two points located on opposite sides with respect to an imaginary plane that passes through the rotation axis of the adjustment cam and at right angles to the adjustment direction. In this manner one obtains a bilateral coupling between the cam followers and the profile of the adjustment cam that avoids resorting to elastic or pneumatic means to maintain contact between the cam followers and the profile of the knockover cams, eliminating all play.

This method has the drawback that it requires the very precise machining of two separate profiles for the adjustment cams, and this can be a problem particularly as regards the synchronization of the profiles around the common rotation axis of the two cams.

As an alternative, it has also been proposed to adopt a single cam that has an outer profile and an inner profile, with which two cam followers associated with the slider are coupled.

The two profiles are provided so that the distance between the axes of the two cam followers remains constant.

This method has the drawback of requiring the provision of a convex outer profile and of a concave inner profile. In particular, the provision of a concave profile, in addition to being more difficult, sets constraints as regards the curvature of the profile and the dimensions of the cam follower that must engage said profile and of the tool for cutting said profile.

SUMMARY OF THE INVENTION

The aim of the present invention is to solve the problems mentioned above by providing a device for varying stitch tightness for knitting machines for hosiery or the like, particularly circular knitting machines, of the type that uses an adjustment cam, which is particularly simple to manufacture and is very precise in changing stitch tightness.

Within this aim, an object of the invention is to provide a device in which the profile of the adjustment cam is simple to provide and does not require particular limitations as regards the cam followers and the cutting tools for providing the cam.

Another object of the invention is to provide a device that by avoiding the use of elastic or pneumatic pushers to maintain contact between the cam followers and the adjustment cam can use lower-power actuators to actuate adjustment cam and/or can increase the actuation speed of the adjustment cam.

Another object of the invention is to provide a device that is structurally simple and highly reliable in operation.

This aim and these and other objects that will become better apparent hereinafter are achieved by a device for varying stitch tightness for knitting machines for hosiery or the like, particularly for circular knitting machines, which comprises a knockover cam that is supported by a portion of the cam box, which faces a needle holder of the machine, said knockover cam having a profile that is inclined with respect to the direction of motion of said needle holder relative to said cam box and being engageable by a heel of the needles or of needle pushers that protrudes from said needle holder toward said cam box; said needle holder having, on its face that faces said cam box, a plurality of slots that run substantially at right angles to said direction of motion, each slot accommodating a needle that can slide along its corresponding slot; said profile of the knockover cam being adapted to produce a movement of the needles, along the corresponding slot of the needle holder, after they have engaged the thread at a feed of the machine, in order to form new loops of knitting; said knockover cam being mounted on a slider that is supported so that it can slide along an adjustment direction in which at least one component is perpendicular to said direction of motion, adjustment means being provided which are associated with said cam box and are connected to said slider for its movement along said adjustment direction, characterized in that said adjustment means comprise an actuator that is connected to an adjustment cam and can be actuated so as to turn said adjustment cam about its own axis through preset angles, said adjustment cam having a single external active profile, two cam followers being arranged on said slider and making contact with said active profile in two spaced points and cooperating in determining a bilateral coupling with said adjustment cam.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
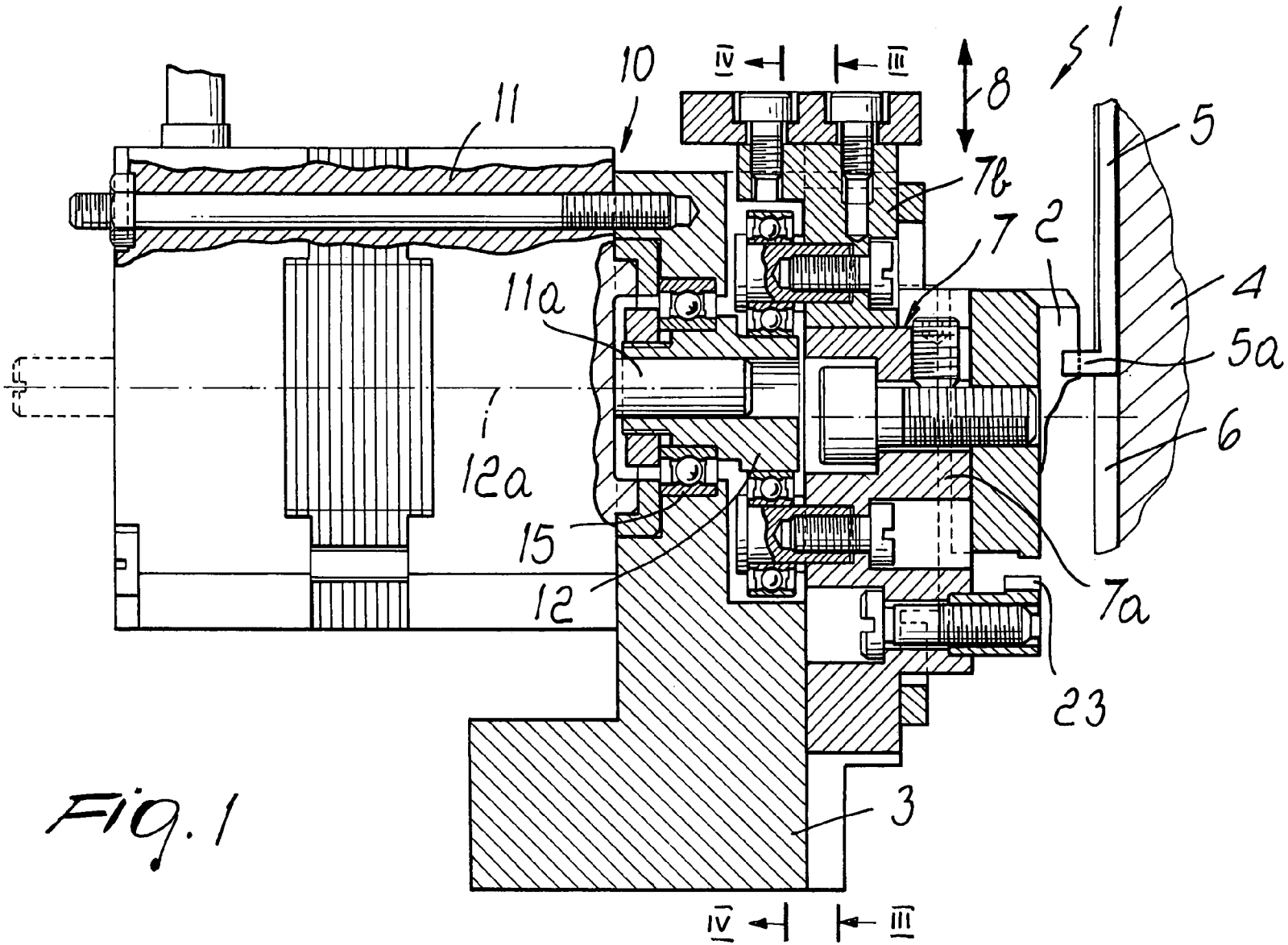
FIG. 1 is a partially sectional side elevation view of a device according to the invention, to be used in circular hosiery knitting machines.
Figure 2:
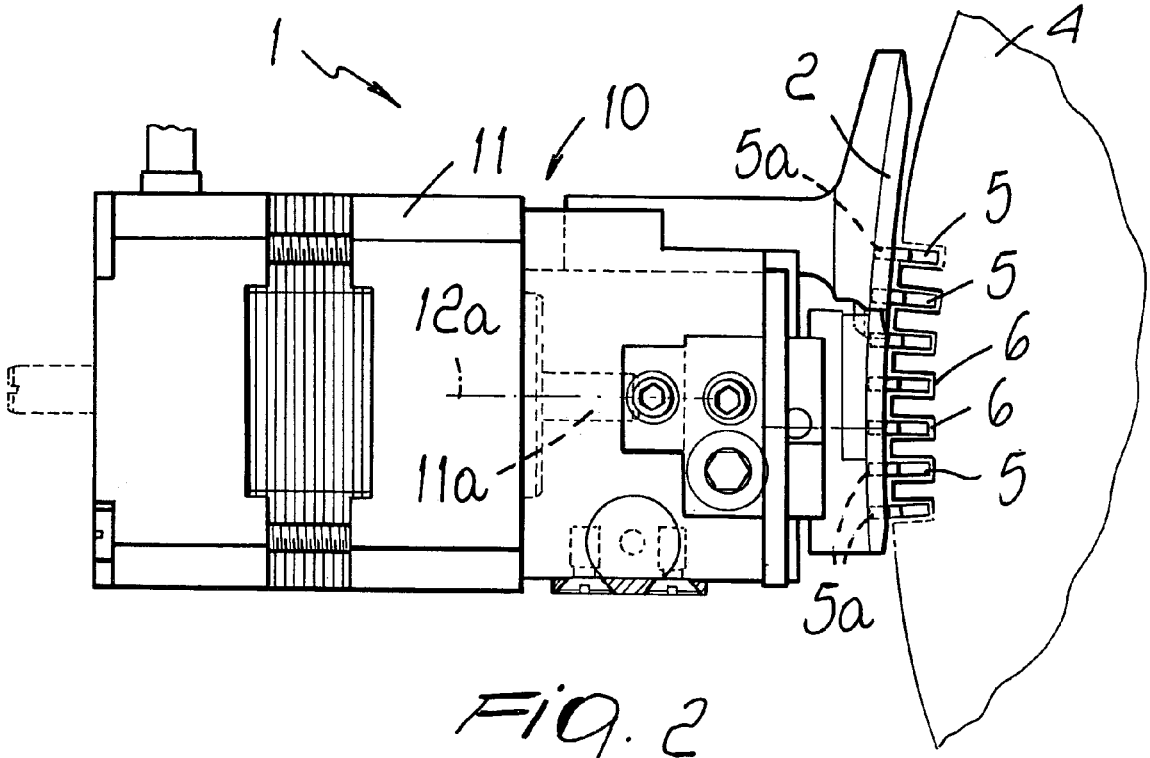
FIG. 2 is a top plan view of the device of FIG. 1.
Figure 3:
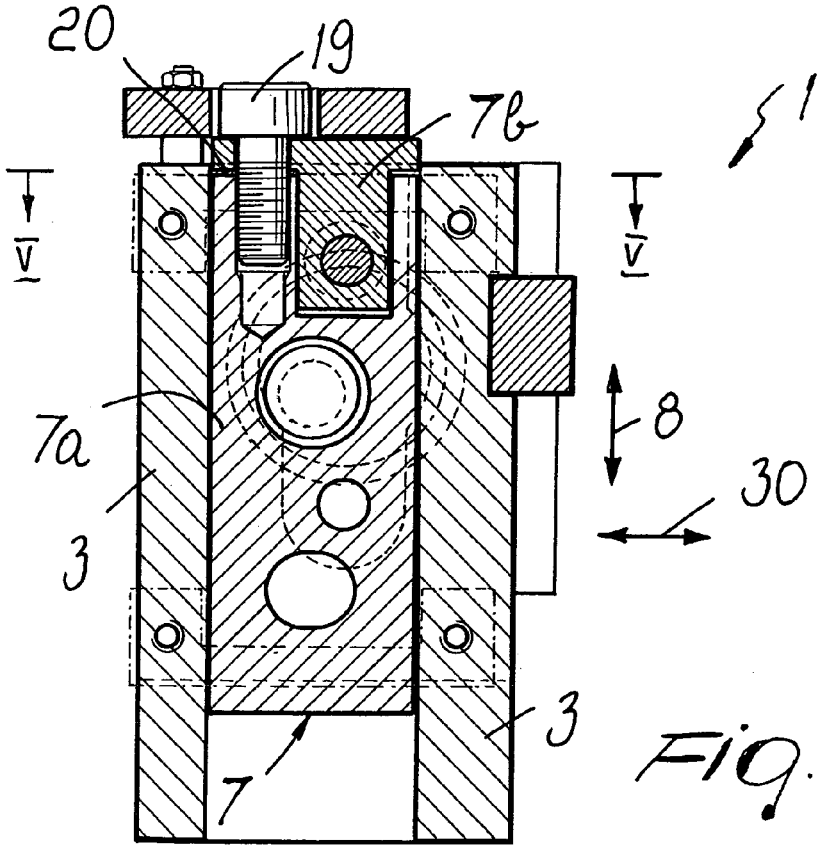
FIG. 3 is a sectional view of FIG. 1, taken along the line III—III.
Figure 5:
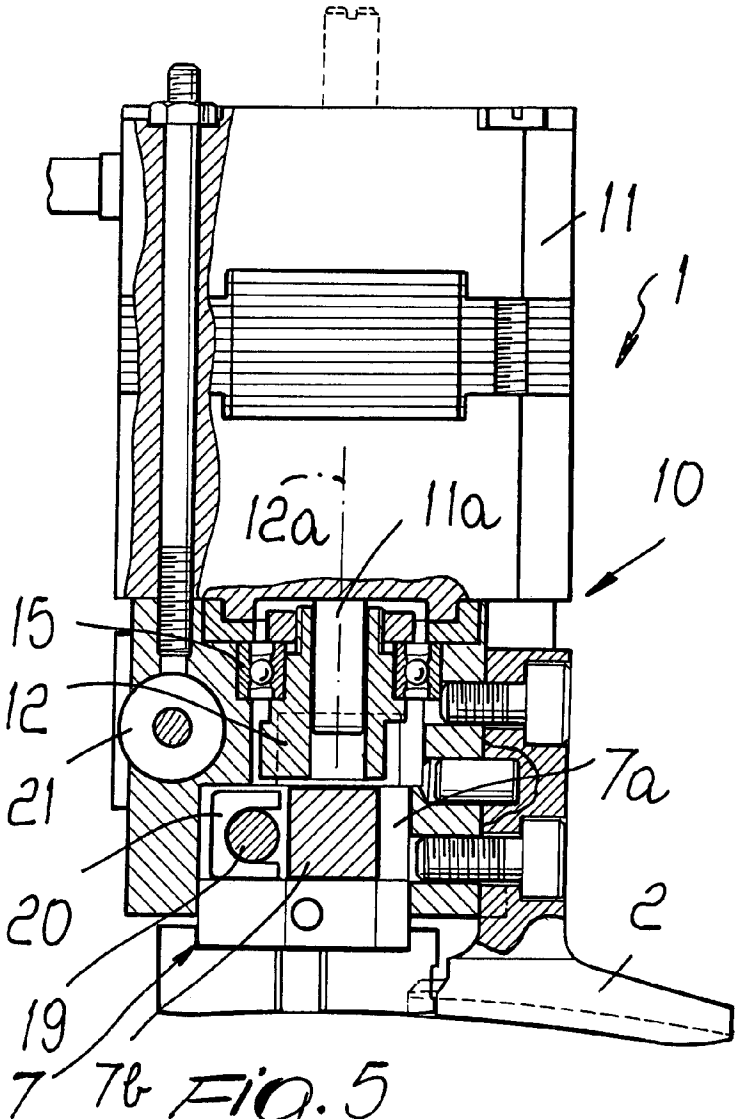
FIG. 5 is a sectional view of FIG. 3, taken along the line V—V.
Figure 4:
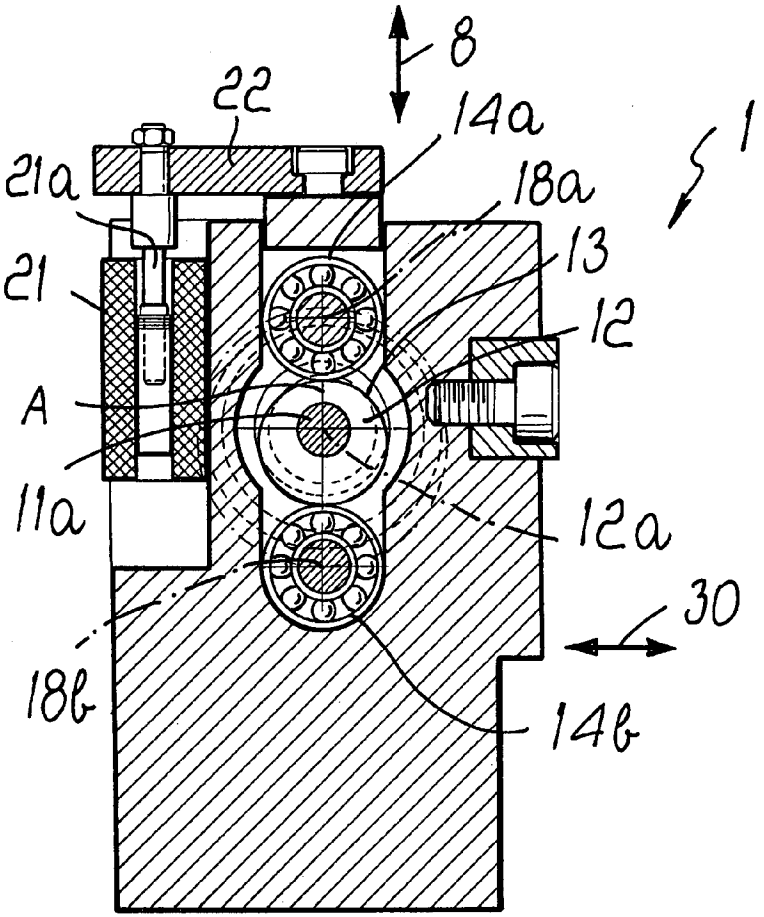
FIG. 4 is a sectional view of FIG. 1, taken along the line IV—IV.

With reference to the figures, the device according to the invention, generally designated by the reference numeral 1, comprises a knockover cam 2, which is supported by a portion of the cam box 3 that faces a needle holder 4 of the hosiery knitting machine on which the device is fitted.

The knockover cam 2 has a profile that is inclined with respect to the direction of motion 30 of the needle holder 4 with respect to the cam box 3; said profile can be engaged by a heel 5*a* of the needles 5 or of needle pushers, which protrudes from the needle holder 4 toward the cam box 3.

The needle holder 4 has, on its face directed toward the cam box 3, a plurality of slots 6 that run substantially at right angles to the direction of motion 30 of the needle holder 4 with respect to the cam box 3; each slot accommodates a needle 5 that can slide along the corresponding slot 6.

The profile of the knockover cam 2 is adapted to produce, as a consequence of the movement of the needle holder 4 with respect to the knockover cam 2, a movement of the needles 5 along the corresponding slot 6 of the needle holder after engaging the thread at a feed of the machine, in order to form new loops of knitting, knocking over the loops of knitting formed previously if said loops of knitting, during the preceding thread engagement step, have been transferred onto the shank of the needle below the open latch of the needle.

In the illustrated embodiment, which refers to a device designed to be mounted on a circular hosiery knitting machine, the illustrated needle holder 4 is constituted by the needle cylinder of the machine, which has a vertical axis and can be actuated with a rotary motion about its own axis with respect to the cam box 3 and therefore with respect to the knockover cam 2.

The slots 6, each of which accommodates a needle 5 and optionally a needle pusher, not shown for the sake of simplicity, are provided on the side wall of the needle cylinder 4 parallel to its axis.

The knockover cam 2 is fixed to a slider 7, which is supported so that it can slide along an adjustment direction 8, which has at least one component that is perpendicular to the direction of motion 30 of the needle holder 4 with respect to the knockover cam 2. In the illustrated embodiment, the slider 7 can slide with respect to the cam box 3 along an adjustment direction 8 that is parallel to the axis of the needle cylinder 4.

The device comprises adjustment means 10, which are associated with the cam box 3 and are connected to the slider 7 in order to produce its movement along the adjustment direction 8 with respect to the cam box 3.

According to the invention, said adjustment means comprise an actuator 11, which is connected to an adjustment cam 12 and can be actuated in order to produce the rotation, through preset angles, of the adjustment cam 12 about its axis 12*a*.

The adjustment cam 12 has a single external active profile 13, and on the slider 7 there are two cam followers 14*a* and 14*b*, which make contact with the active profile 13 in two spaced points thereof; said cam followers 14*a* and 14*b* cooperate in establishing a bilateral coupling with the adjustment cam 12.

Conveniently, the points of contact of the cam followers 14*a* and 14*b* with the active profile 13 are arranged on opposite sides with respect to an imaginary plane that passes through the rotation axis 12*a* of the adjustment cam 12 and at right angles to the adjustment direction 8.

The active profile 13 of the adjustment cam 12 is preferably convex along its entire extension and is symmetrical with respect to an imaginary plane that passes through the rotation axis 12*a* of the adjustment cam 12.

More particularly, the actuator 11 is preferably constituted by a step motor, which is supported by a portion of the cam box 3 and is fixed, by means of its output shaft 11*a,* to the adjustment cam 12. The adjustment cam 12 is supported, so that it can rotate about its own axis 12*a,* by the same portion of the cam box 3 by means of a bearing 15.

The cam followers 14*a* and 14*b* are preferably constituted by rollers, or rather bearings, which have axes 18*a* and 18*b* that are parallel to the axis 12*a* and are supported by the slider 7 so that they can rotate about said axes 18*a* and 18*b*.

The segment A that connects the axes 18*a* and 18*b* of said rollers, perpendicular to said axes 18*a* and 18*b,* passes through the rotation axis 12*a* of the adjustment cam 12.

The center distance of the rollers that constitute the cam followers is constant, and the active profile 13 of the adjustment cam 12 is shaped so as to ensure constantly contact with both rollers.

Conveniently, there are means for adjusting the center distance of the rollers or cam followers 14*a* and 14*b* in order to eliminate, during assembly or thereafter, any plays between the active profile 13 of the cam 12 and the cam followers 14*a* and 14*b*.

More particularly, the slider 7 is formed in two parts, respectively a first part 7*a,* on which the knockover cam 2 and the cam follower 14*b* are mounted, and a second part 7*b,* on which the other cam follower 14*a* is mounted. The second part 7*b* is fixed to the first part 7*a* by means of a fixing screw 19, the axis of which is parallel to the plane that passes through the axes 18*a* and 18*b*. The second part 7*b* of the slider 7, following the loosening of the fixing screw 19, can be moved with respect to the first part 7*a* along a direction that is parallel to the plane that passes through the axes 18*a* and 18*b,* and it is possible to interpose between the part 7*a* and the part 7*b* suitable calibrated shims 20 before tightening the fixing screw 19, so as to adjust and optionally preload very precisely the center distance between the cam followers 14*a* and 14*b*.

The device is completed by means 21 for sensing the movement of the slider 7 and therefore of the knockover cam 2 with respect to the cam box 3 along the adjustment direction 8 produced by the rotation of the adjustment cam 12 about its own axis 12*a*.

Said sensing means can be constituted, in a per se known manner, by a linear transducer, which is mounted on the same portion of the cam box 3 and is provided with an element 21 *a* that can move along a direction that is parallel to the adjustment direction 8 and is connected to a portion 22 of the slider 7.

For the sake of completeness in description, it must be noted that a complementary cam 23 is also fixed to the slider 7 and faces, with its profile, the knockover cam 2.

The operation of the device according to the invention is as follows.

When one wishes to change the tightness of the knitting, one actuates the actuator 11, which turns the adjustment cam 12 about its own axis 12*a* through a preset angle, producing, as a consequence of the shape of its active profile 13, a movement of the slider 7 along the adjustment direction 8.

It should be noted that for adjustment purposes the adjustment cam 12 can be turned equally always in a same direction or in two opposite directions.

In practice it has been found that the device according to the invention fully achieves the intended aim, since by the fact that it adjusts the position of the knockover cam by way of an adjustment cam provided with a single outer active profile, it can be provided in a relatively simple manner and without particular limitations as regards the radii of curvature of the profile of the cam and as regards the sizing of the cam followers.

Although the device has been illustrated in its application to the needle cylinder of a circular hosiery knitting machine, it can also be fitted to the dial in circular machines of the cylinder-and-dial type. In this case, the face of the knockover cam 2 that is directed toward the needle holder, which in this case is constituted by the dial, is substantially flat.

Likewise, the device according to the invention can also be used on rectilinear knitting machines.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2001A002650 from which this application claims priority are incorporated herein by reference.

What is claimed is:

1. A device for varying stitch tightness for circular knitting machines with a cam box, a needle holder, needle pushers, needles, comprising: a knockover cam that is supported by a portion of the cam box, which faces the needle holder of the machine, said knockover cam having a profile that is inclined with respect to a direction of motion of said needle holder relative to said cam box and being engageable by a heel of the needles or of needle pushers that protrudes from said needle holder toward said cam box; said needle holder having, on a face thereof that faces said cam box, a plurality of slots that run substantially at right angles to said direction of motion, each slot accommodating a needle that is slideable along a corresponding slot thereof; said profile of the knockover cam being adapted to produce a movement of the needles, along the corresponding slot of the needle holder, after the needles have engaged a thread at a feed of the machine, in order to form new loops of knitting; a slider that is supported so as to be slideable along an adjustment direction with at least one component perpendicular to said direction of motion, said knockover cam being mounted on said slider; adjustment means connected to said cam box and connected to said slider for movement along said adjustment direction, wherein said adjustment means comprises an actuator connected to an adjustment cam and actuatable so as to turn said adjustment cam about an axis thereof through preset angles, said adjustment cam having a single external active profile, and wherein two cam followers are arranged on said slider so to make contact with said active profile in two spaced points thereof, and to cooperate in determining a bilateral coupling with said adjustment cam, wherein said contact points are arranged at opposite sides with respect to an imaginary plane that passes through the rotation axis of the adjustment cam and is perpendicular to said adjustment direction.

2. The device of claim 1, wherein the active profile of said adjustment cam is convex.

3. The device of claim 2, wherein the active profile of said adjustment cam is symmetrical with respect to an imaginary plane that passes through the rotation axis of said adjustment cam.

4. The device of claim 1, wherein said two cam followers comprise two rollers with axes thereof that are parallel to the rotation axis of said adjustment cam and are supported by said slider so that the rollers can rotate about said respective axes thereof.

5. The device of claim 4, wherein a segment that connects the axes of said rollers, is arranged at right angles to the axes of said rollers, passes through the rotation axis of said adjustment cam.

6. The device of claim 4, wherein a center distance of said rollers is constant and said active profile of the adjustment cam is shaped so as to constantly ensure contact with both of said rollers.

7. The device of claim 4, comprising adjustment means for adjusting the center distance of said rollers.

8. The device of claim 7, wherein one of said rollers is mounted on a portion of said slider with a position thereof with respect to the portion of said slider that supports the other roller that is adjustable along a direction that is parallel to the plane that passes through the axes of said rollers.

9. The device of claim 8, comprising sensor means for sensing movement of said slider with respect to said cam box along said adjustment direction produced by the rotation of said adjustment cam.

10. A device for varying stitch tightness for circular knitting machines with a cam box, a needle holder, needle pushers, needles, comprising: a knockover cam that is supported by a portion of the cam box, which faces the needle holder of the machine, said knockover cam having a profile that is inclined with respect to a direction of motion of said needle holder relative to said cam box and being engageable by a heel of the needles or of needle pushers that protrudes from said needle holder toward said cam box; said needle holder having, on a face thereof that faces said cam box, a plurality of slots that run substantially at right angles to said direction of motion, each slot accommodating a needle that is slideable along a corresponding slot thereof; said profile of the knockover cam being adapted to produce a movement of the needles, along the corresponding slot of the needle holder, after the needles have engaged a thread at a feed of the machine, in order to form new loops of knitting; a slider that is supported so as to be slideable along an adjustment direction with at least one component perpendicular to said direction of motion, said knockover cam being mounted on said slider; adjustment means connected to said cam box and connected to said slider for movement along said adjustment direction, wherein said adjustment means comprises an actuator connected to an adjustment cam and actuatable so as to turn said adjustment cam about an axis thereof through preset angles, said adjustment cam having a single external active profile, and wherein two cam followers are arranged on said slider so to make contact with said active profile in two spaced points thereof, and to cooperate in determining a bilateral coupling with said adjustment cam, wherein the active profile of said adjustment cam is convex.

11. The device of claim 10, wherein said contact points are arranged at opposite sides with respect to an imaginary plane that passes through the rotation axis of the adjustment cam and is perpendicular to said adjustment direction.

12. The device of claim 10, wherein the active profile of said adjustment cam is symmetrical with respect to an imaginary plane that passes through the rotation axis of said adjustment cam.

13. The device of claim 10, wherein said two cam followers comprise two rollers with axes thereof that are parallel to the rotation axis of said adjustment cam and are supported by said slider so that the rollers can rotate about said respective axes thereof.

14. The device of claim 13, wherein a segment that connects the axes of said rollers, is arranged at right angles to the axes of said rollers, passes through the rotation axis of said adjustment cam.

15. The device of claim 13, wherein a center distance of said rollers is constant and said active profile of the adjustment cam is shaped so as to constantly ensure contact with both of said rollers.

16. The device of claim 13, comprising adjustment means for adjusting the center distance of said rollers.

17. The device of claim 16, wherein one of said rollers is mounted on a portion of said slider with a position thereof with respect to the portion of said slider that supports the other roller that is adjustable along a direction that is parallel to the plane that passes trough the axes of said rollers.

18. The device of claim 17, comprising sensor means for sensing movement of said slider with respect to said cam box along said adjustment direction produced by the rotation of said adjustment cam.

* * * * *